US011387090B2

(12) United States Patent
Miwa et al.

(10) Patent No.: US 11,387,090 B2
(45) Date of Patent: Jul. 12, 2022

(54) MASS SPECTROMETRY DEVICE

(71) Applicant: JEOL Ltd., Tokyo (JP)

(72) Inventors: Yoshihiko Miwa, Tokyo (JP); Yasunori Nishimura, Tokyo (JP); Keiko Kaneda, Tokyo (JP); Shintarou Yamada, Tokyo (JP); Yuta Nakaoka, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 17/152,836

(22) Filed: Jan. 20, 2021

(65) Prior Publication Data

US 2021/0225630 A1 Jul. 22, 2021

(30) Foreign Application Priority Data

Jan. 21, 2020 (JP) ..... JP2020-007265

(51) Int. Cl.

*H01J 49/04* (2006.01)
*H01J 49/02* (2006.01)
*H01J 49/40* (2006.01)

(52) U.S. Cl.

CPC ..... *H01J 49/0468* (2013.01); *H01J 49/022* (2013.01); *H01J 49/401* (2013.01)

(58) Field of Classification Search

CPC .. H01J 49/022; H01J 49/0467; H01J 49/0468; H01J 49/40; H01J 49/067; H01J 49/068

See application file for complete search history.

(56) References Cited

U.S. PATENT DOCUMENTS

| | | | | |
|---|---|---|---|---|
| 5,744,797 | A | 4/1998 | Park | |
| 2013/0015347 | A1 | 1/2013 | Steiner | |
| 2021/0142999 | A1 * | 5/2021 | Kudo | H01J 29/82 |

FOREIGN PATENT DOCUMENTS

| | | | | |
|---|---|---|---|---|
| JP | 51047281 | U * | 4/1976 | |
| JP | S5147281 | U | 4/1976 | |
| JP | 5840761 | A | 3/1983 | |
| JP | 52048481 | U | 4/1997 | |
| JP | 2004362903 | A | 12/2004 | |
| WO | 2019229864 | A1 | 5/2019 | |
| WO | WO-2019229864 | A1 * | 12/2019 | H01J 19/44 |

OTHER PUBLICATIONS

Extended European Search Report issued in EP20217913.1 dated Jun. 22, 2021.

List of Thermal Conductivities, Apr. 16, 2020, pp. 1-31, https://en.wikipedia.org/w/index.php?Title=List_of_thermal_conductivities&oldid=95135042.

Office Action issued in JP2020007265 dated Dec. 14, 2021.

* cited by examiner

*Primary Examiner* — David E Smith

(74) *Attorney, Agent, or Firm* — The Webb Law Firm

(57) ABSTRACT

A constructed unit is fixed to a base by means of a plurality of support posts while being spaced from the base. The constructed unit includes an orthogonal acceleration unit. An incidence regulator unit is fixed to the base by a pair of support posts while being spaced from the base and the constructed unit. The incidence regulator unit includes, among others, a pair of blades that define a slit, and heaters for heating the pair of blades.

4 Claims, 5 Drawing Sheets

MASS SPECTROMETRY DEVICE

CROSS REFERENCE TO RELATED APPLICATION

This application claims priority to Japanese Patent Application No. 2020-007265 filed Jan. 21, 2020, the disclosure of which is hereby incorporated by reference in its entirety.

BACKGROUND OF THE INVENTION

Field of the Invention

The present disclosure relates to a mass spectrometry device, and more particularly to a structure of a time-of-flight mass spectrometry device.

Description of Related Art

A time-of-flight mass spectrometry device comprises, for example, a pulse generator unit (typically an orthogonal acceleration unit) that generates ion pulses from an ion flow, a reflector unit that reverses the flight direction of the ion pulses, and a detector unit that detects the ion pulses from the reflector unit. In the course of the flight, the ion pulses elongate in the trajectory direction in accordance with the mass-to-charge ratios (m/z) of the individual ions constituting the ion pulses, and form a band-like shape. By detecting such ion pulses, mass spectrum information can be obtained.

In order to correctly introduce the ion flow to a reference plane of the pulse generator unit, an incidence regulator unit is provided upstream of the pulse generator unit. The incidence regulator unit comprises, for example, a vertically-arranged pair of blades. A gap between a pair of edges that form parts of the pair of blades functions as a slit through which the ion flow is passed.

JP 2004-362903 A discloses a time-of-flight mass spectrometry device comprising an incidence regulator unit. However, in JP 2004-362903 A, respective components constituting the mass spectrometry device are described schematically or abstractly, and no concrete structure can be identified from those descriptions.

In order to generate suitable ion pulses in a time-of-flight mass spectrometry device, it is necessary to position the incidence regulator unit relative to the pulse generator unit with high positioning accuracy. In other words, the spatial relationship between the incidence regulator unit and the pulse generator unit must be highly optimized.

Meanwhile, in the incidence regulator unit, in order to prevent or reduce soiling of the pair of blades with ions, the pair of blades are heated. It is desired to maintain an appropriately heated state of the incidence regulator unit while suppressing escape of heat therefrom.

One object of the present disclosure is to position, in a mass spectrometry device, an incidence regulator unit relative to a pulse generator unit with high positioning accuracy. An alternative object of the present disclosure is to maintain an appropriately heated state of an incidence regulator unit in a mass spectrometry device.

SUMMARY OF THE INVENTION

A mass spectrometry device according to the present disclosure comprises a base, a constructed unit including a pulse generator unit that generates ion pulses from an ion flow, a first support member that fixes the constructed unit with respect to the base while isolating the constructed unit from the base, an incidence regulator unit provided upstream of the pulse generator unit and having a slit through which the ion flow passes, and a second support member that fixes the incidence regulator unit with respect to the base while isolating the incidence regulator unit from the base and the constructed unit.

BRIEF DESCRIPTION OF THE DRAWINGS

Embodiment(s) of the present disclosure will be described based on the following figures, wherein.

DESCRIPTION OF THE INVENTION

Figure 1:
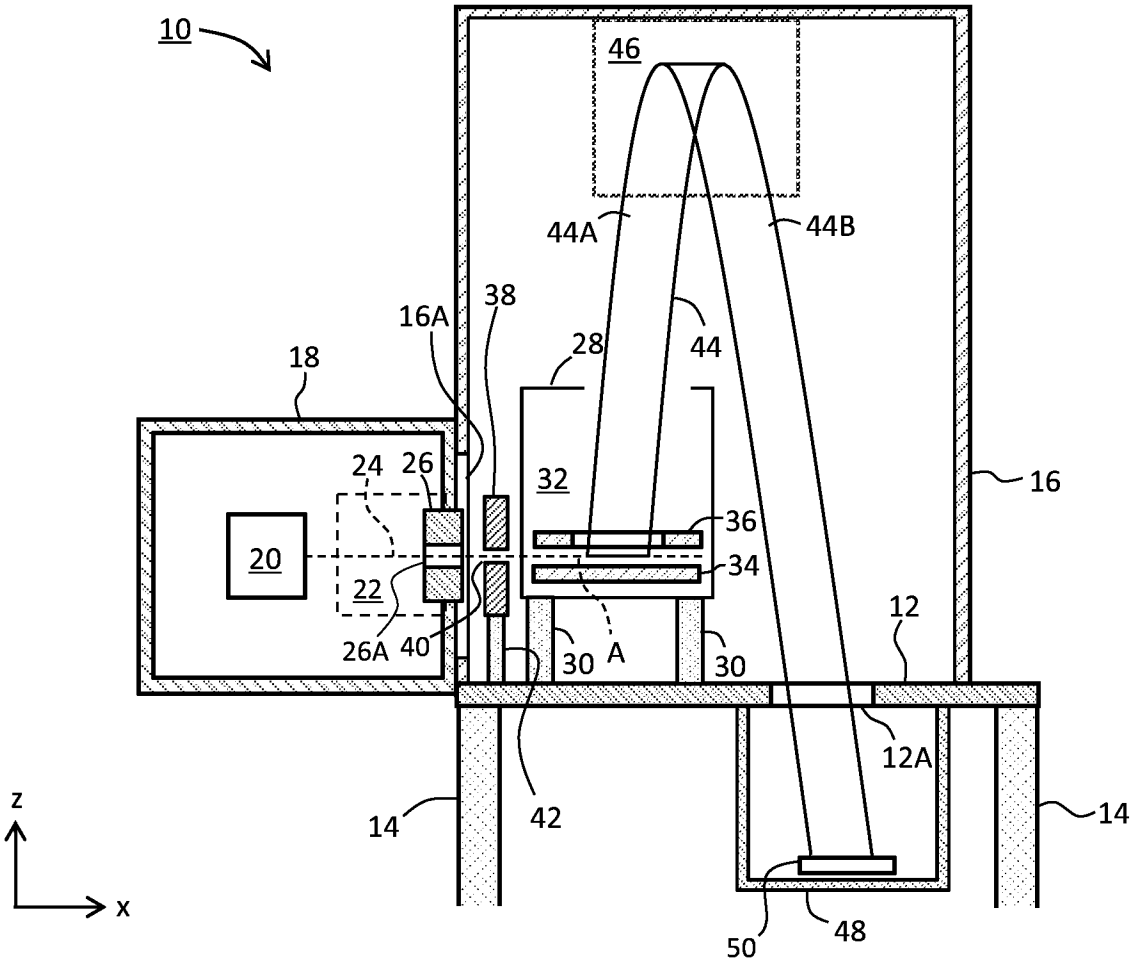
FIG. 1 is a cross-sectional view showing a configuration of a mass spectrometry device according to an embodiment.

Embodiments will be described below based on the drawings.

(1) Overview of Embodiments

A mass spectrometry device according to an embodiment includes a base, a constructed unit, a first support member, an incidence regulator unit, and a second support member. The constructed unit comprises a pulse generator unit that generates ion pulses from an ion flow. The first support member is a member that fixes the constructed unit with respect to the base while isolating the constructed unit from the base. The incidence regulator unit is a unit provided upstream of the pulse generator unit, and has a slit through which the ion flow passes. The second support member is a member that fixes the incidence regulator unit with respect to the base while isolating the incidence regulator unit from the base and the constructed unit.

If the constructed unit, which comprises a pulse generator unit, and the incidence regulator unit are coupled to each other via a number of components, machining errors and assembly errors of the respective intervening components would accumulate, making it difficult to attain an appropriate spatial relationship between the pulse generator unit and the incidence regulator unit. In contrast, according to the above-described configuration, the constructed unit and the incidence regulator unit are both fixed with respect to a common base, so that the spatial relationship between the pulse generator unit and the incidence regulator unit can be easily optimized. Further, according to the above-described configuration, since the constructed unit is fixed with respect to the base via the first support member while the incidence regulator unit is fixed with respect to the base via the second support member, it is easy to heat the constructed unit and the incidence regulator unit independently of each other. That is, direct heat conduction to the base from the constructed unit and from the incidence regulator unit can be prevented, and escape of heat via the base can thereby be suppressed. In addition, since the constructed unit and the incidence regulator unit are not directly coupled, direct heat transfer between these units can be prevented. For this reason, the pulse generator unit (which may also be heated to prevent or reduce soiling with ions) and the incidence regulator unit can be easily maintained at their respective temperatures.

In an embodiment, the incidence regulator unit includes a main body, a pair of blades, and a heat source. The pair of blades are provided on the main body. The heat source is provided on the main body and serves to heat the pair of blades. By heating the pair of blades, soiling of the pair of blades with ions can be reduced. Soiling with ions leads to electrostatic charging, and due to this charging, the trajectory of the ion flow becomes unstable. When soiling with ions can be reduced, the trajectory of the ion flow can be stabilized, and workload for maintenance can be reduced. The potential of the pair of blades may be set to ground potential.

In an embodiment, when assuming that a direction parallel to a direction of travel of the ion flow is defined as a first direction, that a direction orthogonal to the first direction and parallel to the slit is defined as a second direction, and that a direction orthogonal to the first direction and the second direction is defined as a third direction, the main body extends in the second direction and the third direction. A pair of mounts is provided projecting toward both sides in the second direction from an end portion of the main body, which end portion is located toward the base. The second support member is a pair of support posts provided between the base and the pair of mounts. Each of the support posts extends in the third direction.

Since the mounts project from the two lateral faces of the main body, work for attaching the support posts to the mounts is facilitated. Further, heat escape can be suppressed as compared to a case in which the pair of support posts is directly attached to the main body. In an embodiment, the first direction is a first horizontal direction, the second direction is a second horizontal direction, and the third direction is a vertical direction. A portion (i.e., one end portion) of each support post may extend past the corresponding mount to the opposite side (i.e., a side located away from the base), and a portion (i.e., the other end portion) of each support post may extend into the base.

In an embodiment, each support post comprises a bolt. The bolt is placed through a through hole formed in the mount and a through hole formed in the support post, and is coupled to the base. The head of the bolt is exposed at the mount. According to this arrangement, access to the head of each bolt with a tool is facilitated. In other words, assembly work efficiency can be increased.

In an embodiment, the heat source includes a first heater embedded in the main body on one side of the pair of blades, and a second heater embedded in the main body on the other side of the pair of blades. According to this arrangement, since the pair of blades is located between the two heaters, the pair of blades can be uniformly heated in a stable manner. If the pair of support posts were directly attached to a lower part of the main body, heat generated by the two heaters would easily escape. In an embodiment, the pair of support posts are attached to the pair of mounts projecting from the main body instead of being attached to the main body, so that the heat conduction path is longer, and heat escape can be suppressed to some extent. Here, although it is possible to form the second support member with a single support post, in that case, the orientation of the incidence regulator unit tends to be unstable. According to the above-described arrangement, the incidence regulator unit can be fixed stably with respect to the base.

In an embodiment, on one side of the base, there are provided the constructed unit, the first support member, the incidence regulator unit, and the second support member, and further, a reflector unit that reflects ions from the pulse generator unit. On the other side of the base, a detector that detects ions from the reflector unit is provided. A member that holds the detector is fixed with respect to the base.

According to the above-described configuration, since the main structures are fixed with respect to the base, positioning accuracy of the respective components can be enhanced. Further, both of one side and the other side of the base can be used as the ion flight space, so that resolution can be increased.

(2) Details of Embodiments

FIG. 1 illustrates an example configuration of a time-of-flight mass spectrometry device 10 according to an embodiment. The illustrated mass spectrometry device 10 is, for example, a device that obtains mass spectrum information by ionizing a compound gas fed from a gas chromatograph (not shown) and analyzing masses of the individual ions produced as a result of the ionization. The time of flight (flight velocity) of each ion depends on mass-to-charge ratio (m/z) of that ion. Using this relationship, the mass-to-charge ratios (m/z) of the individual ions are determined. In FIG. 1, an x-direction denotes the first horizontal direction, and a z-direction denotes the vertical direction (upright direction). Although a y-direction is not shown in FIG. 1, the y-direction denotes the second horizontal direction. The respective directions are orthogonal to each other.

In FIG. 1, the mass spectrometry device 10 comprises a base 12, which is a horizontal plate extending in the x-direction and the y-direction. The base 12 is installed on a floor via a plurality of legs 14. The height of the base 12 is an intermediate height in the mass spectrometry device 10. The base 12 is composed of a metal such as aluminum, for example.

On an upper side of the base 12, a housing 16 is provided. On one side of the housing 16, a housing 18 is provided. On a lower side of the base 12, a housing 48 is provided. The housing 16, the housing 18, and the housing 48 are composed of a metal such as aluminum, for example, and the interiors of these housings are in a vacuum state. In FIG. 1, illustration of vacuum pumps is omitted.

On the inside of the housing 18, an ion source 20 is provided. A gas from the gas chromatograph is introduced into the ion source 20 as a specimen. As the ion source 20, ion sources operating according to various ionization methods can be employed. According to an embodiment, in the ion source 20, ions are generated continuously, and the ions are ejected in a horizontal direction. As a result, an ion flow 24 is produced continuously. In the ion source or in the downstream region thereof, a pulse-like ion flow may be formed. Reference numeral 22 indicates an ion flow shaping unit including a lens system. This ion flow shaping unit can be referred to as an ion introducing unit from the perspective of an orthogonal acceleration unit 32 described further below. In the illustrated example configuration, the flow direction of the ion flow 24 is parallel to the x-direction.

On the housing 18, an annular flange 26 is provided. The ion flow 24 passes through an opening 26A formed in the flange 26. The housing 16 has an opening 16A for attaching the housing 18. In the illustrated example configuration, a part of the flange 26 extends into the opening 16A. It is possible to also provide a flange on the housing 16 side and to couple this flange with the flange 26. In any case, the two housings 16, 18 are coupled to each other in such a manner that the vacuum inside the housings 16, 18 is maintained.

A constructed unit 28, which is a structure or an assembly composed of a plurality of components, is arranged inside the housing 16. The constructed unit 28 comprises the orthogonal acceleration unit 32 that functions as the pulse generator unit. The orthogonal acceleration unit 32 serves to periodically extract ion pulses from the ion flow. The ion pulses are emitted in the z-direction (upward in FIG. 1). In FIG. 1, the trajectory of the ion pulses is indicated by reference numeral 44.

A reflector unit 46 is referred to as a reflector or a reflectron, and serves to reverse the direction of travel of the individual ions. The reflector unit 46 comprises a plurality of electrodes that form an electric field for reflecting ions. The trajectory of the ion pulses before reversal is indicated by reference numeral 44A, while the trajectory of the ion pulses after reversal is indicated by reference numeral 44B. Because the ions constituting the ion pulses have various mass-to-charge ratios, the ion pulses elongate in the trajectory direction in the course of the flight. The entire flight path of the ion pulses corresponds to a mass analyzing section.

The orthogonal acceleration unit 32 comprises a plurality of electrodes. Among those electrodes, FIG. 1 shows two electrodes 34, 36 that define a reference plane A. The electrode 34 is a pusher electrode, while the electrode 36 is a puller electrode. Each of these electrodes has a shape of a flat plate, and the two electrodes are arranged in parallel with each other. In the gap between the two electrodes, a plane corresponding to an intermediate position in the z-direction is the reference plane A. Although a plurality of additional electrodes are arranged alongside each other above the electrode 36, illustration of those electrodes is omitted.

The constructed unit 28 is fixed to the base 12 by means of four support posts 30 while being spaced from the base 12 (and the housing 16). The support posts 30 constitute the first support member. The orthogonal acceleration unit 32 is heated by a heat source (not shown). For example, the temperature of the electrode 34 is maintained at 100° C. With this arrangement, soiling of the electrode 34 with ions can be reduced. Electrodes other than the electrode 34 may be heated. The heat source for the heating may be arranged inside or outside the constructed unit 28. The heat source may be embedded in the electrode 34. The heat source may be configured with, for example, one or more heaters.

Since the constructed unit 28 is fixed to the base 12 via the plurality of support posts 30, heat conduction from the constructed unit 28 to the base 12 can be reduced as compared to a case in which the constructed unit 28 is directly fixed to the base 12. The individual support posts 30 may be composed of a material having relatively low thermal conductivity. For example, the individual support posts 30 may be composed of stainless steel. When designing the mass spectrometry device 10, thermal expansion of the respective components is taken into consideration.

Upstream of the orthogonal acceleration unit 32, an incidence regulator unit 38, which can be referred to as a regulator, is provided. The incidence regulator unit 38 includes a slit 40 through which the ion flow is passed. By means of the incidence regulator unit 38, incidence of the ion flow is regulated in such a manner that the ion flow having a planar shape is located in the reference plane A. As described below, the incidence regulator unit 38 comprises components such as a pair of blades that define the slit, and a pair of heaters serving as a heat source for heating the pair of blades.

The incidence regulator unit 38 is fixed with respect to the base 12 by means of a pair of support posts 42 while being spaced from the base 12 (and the housing 16). The pair of support posts 42 function as the second support member. The support posts may be composed of stainless steel. The pair of blades are heated by the pair of heaters. The temperature of the pair of blades is maintained at 200° C., for example. Since the incidence regulator unit 38 is spaced from components other than the pair of support posts 42, heat escape from the incidence regulator unit 38 is suppressed. When mounting the incidence regulator unit 38 in place, thermal expansion of the support posts 42 is taken into consideration.

If the incidence regulator unit 38 were directly fixed to the constructed unit 28, heat transfer from the incidence regulator unit 38 to the constructed unit 28 would be generated, which would cause the temperature of the constructed unit 28 to be unstable or non-uniform, or as a result of which more electric energy would be required for maintaining the temperature of the pair of blades to a predetermined temperature. According to the configuration of the embodiment, generation of these problems can be avoided. Although attaching the incidence regulator unit 38 to the flange 26 might be considered, in that case, the amount of heat escape would be increased, and further, positioning error of the incidence regulator unit 38 would undesirably be increased. According to the configuration of the embodiment, occurrence of these problems can also be avoided.

Inside the housing 48, a detector 50 is provided. By means of the detector 50, the temporally-extended ion pulses are detected. Based on detection signals generated as a result of the detection, a mass spectrum is produced. An opening 12A through which the ion pulses pass is formed in the base 12. In an embodiment, the constructed unit 28, the incidence regulator unit 38, and the reflector unit 46 are provided on one side (more specifically, on the upper side) of the base 12, while the detector 50 is provided on the other side (more specifically, on the lower side) of the base 12. With this arrangement, the flight distance of the ion pulses is increased, and accuracy of mass spectrometry can thereby be enhanced. The detector 50 may be installed at a further lower position. By employing spaces on both sides of the base 12, it becomes possible to configure such that the flight distance is 3 to 4 meters, for example. Since the housing 48 that holds the detector 50 is fixed to the base 12, positioning accuracy of the detector 50 can be increased.

In the above-described configuration, a linear acceleration unit may be provided instead of the orthogonal acceleration unit. Further, the respective components may be arranged so as to invert the trajectory 44. In FIG. 1, illustration of a data processor unit and a control unit is omitted.

Figure 2:
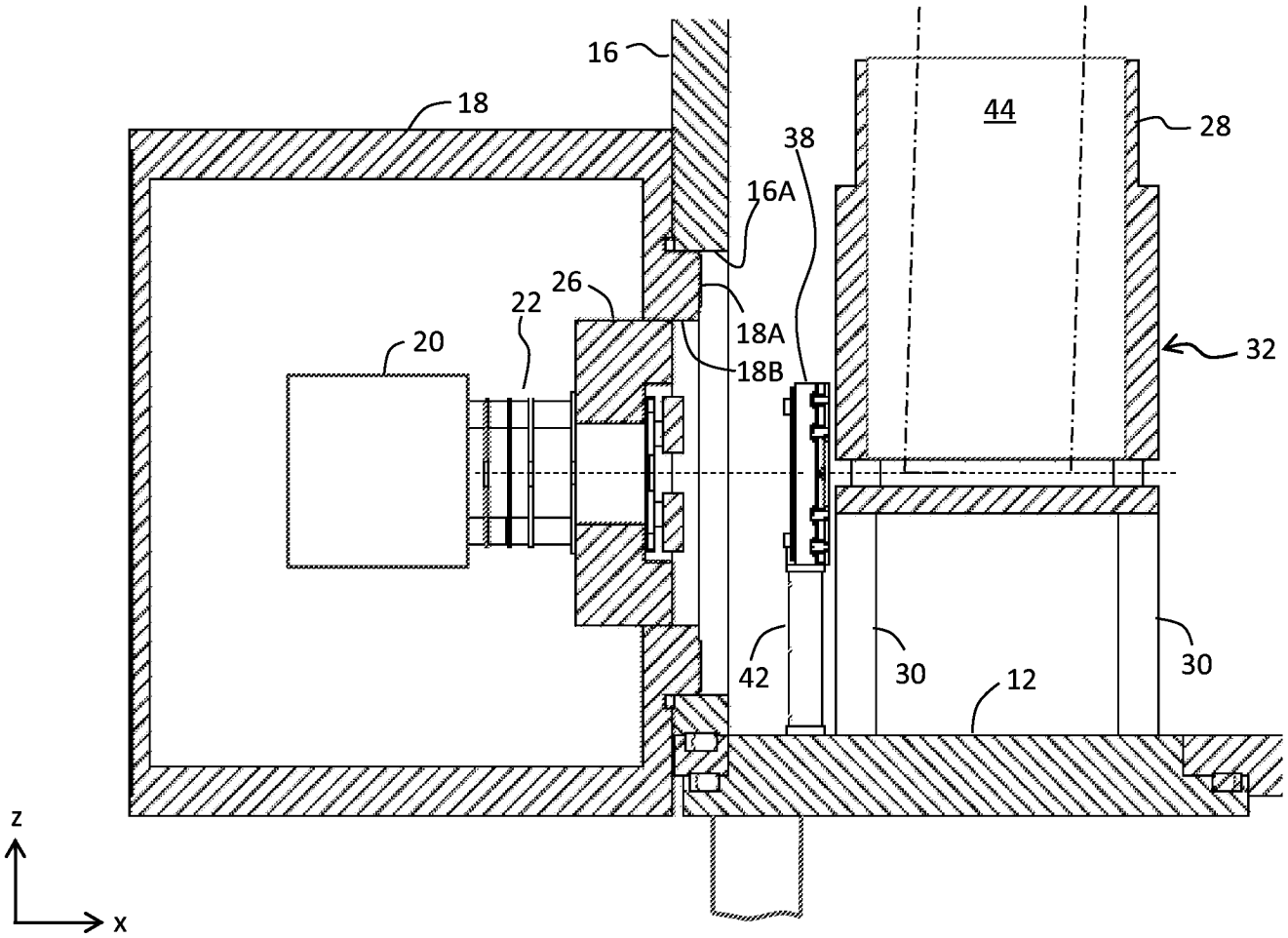
FIG. 2 is a cross-sectional view showing a detailed configuration of an incidence regulator unit and its surroundings.

FIG. 2 shows details of the incidence regulator unit 38 and its surroundings in an enlarged view. Meanwhile, the structure of the orthogonal acceleration unit 32 is expressed schematically. In FIG. 2, elements shown in FIG. 1 are labeled with the same reference numerals, and their explanation will not be repeated below.

The housing 18 is attached to the housing 16. These housings are composed of, for example, a metal such as aluminum. A round end portion 18A of the housing 18 projects in the x-direction, and fits into the round opening 16A formed on the housing 16. The end portion 18A has a round opening 18B, and the annular flange 26 is arranged in the opening 18B. At each point of joining between the above-noted plurality of components, a sealing member such as an O-ring is provided.

Inside the housing 16, the constructed body 28 including the orthogonal acceleration unit 32 is arranged. The constructed body 28 is fixed to the base 12 by the support posts 30. Inside the housing 16, the incidence regulator unit 38 is provided, and is fixed to the base 12 by the pair of support posts 42. The height of the incidence regulator unit 38, or more specifically, the height of the slit, is adjusted to correspond, with high accuracy, to the above-described reference plane. Although a component that captures or blocks the ion flow that has passed in a horizontal direction through the orthogonal acceleration unit 32 is actually provided, its illustration is omitted.

Figure 3:
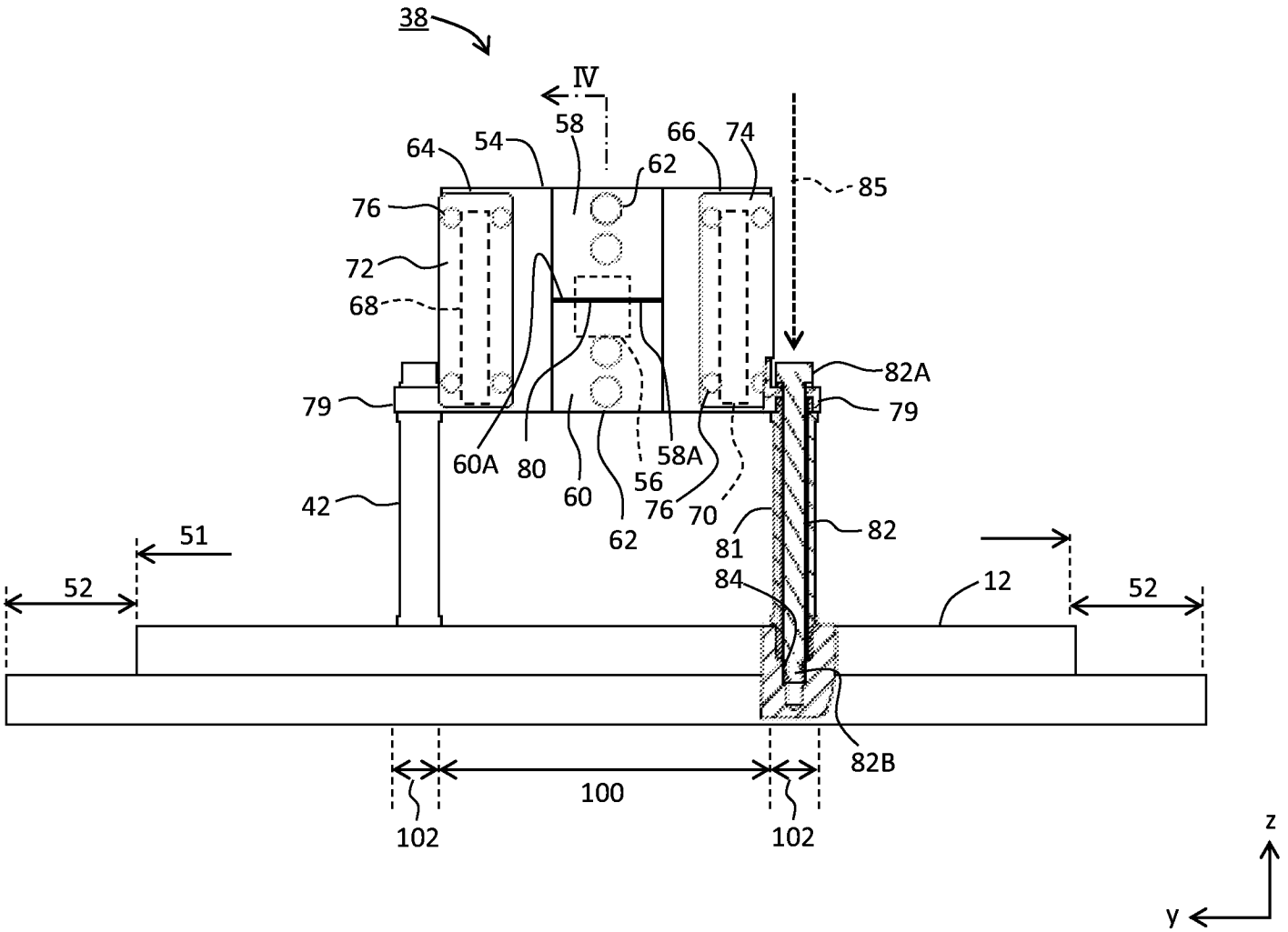
FIG. 3 is a front view of the incidence regulator unit.

FIG. 3 shows a front view of the incidence regulator unit 38. The incidence regulator unit 38 comprises a main body 54, the pair of blades 58, 60, and heater units 64, 66. The pair of blades 58, 60 are arranged alongside each other in the z-direction, and are detachably fastened to the main body 54 with a plurality of screws 62. The pair of blades 58, 60 have a pair of edges 58A, 60A, and a width of the slit 80 in the z-direction is defined between these edges 58A, 60A. The main body 54 has an opening 56, and the opening 56 defines a length of the slit 80 in the y-direction. This length is typically greater than the width of the ion flow. It is of course alternatively possible to use the opening 56 to limit the width, in the y-direction, of the ion flow.

For example, the blades 58, 60 are made of molybdenum, which is a non-magnetic metal. When the blades 58, 60 become soiled with ions to a degree exceeding a predetermined level, the pair of blades 58, 60 are removed from the main body 54 and are subjected to cleaning (more specifically, sanding).

At each of two ends of the main body 54 in the y-direction, a U-shaped groove is formed. A pair of heaters 68, 70 are arranged inside this pair of U-shaped grooves, and then the pair of U-shaped grooves are covered with a pair of covers 72, 74. The pair of covers 72, 74 are fastened to the main body 54 with a plurality of screws 76. The pair of U-shaped grooves, the pair of heaters 68, 70, and the pair of covers 72, 74 constitute the pair of heater units 64, 66. Upon heating, the pair of heaters 68, 70 expand, and their outer faces come in close contact with the inner faces of the respective U-shaped grooves, resulting in good heat conduction. For achieving better heat conduction, a heat conduction sheet such as a flexible copper foil may be arranged between the outer face of each heater 68, 70 and the inner face of the corresponding U-shaped groove.

The main body 54 has a plate-shaped form as a whole, and specifically has a rectangular shape when viewed in the x-direction. In other words, the main body 54 has a shape that extends in the y-direction and the z-direction. The width of main body 54 in the y-direction is indicated by reference numeral 100.

A pair of mounts 79 are provided at lower portions of the main body 54. The pair of mounts 79 project outward from the lower end portions, located on both sides in the y-direction, of the main body 54. The extent of projection is indicated by reference numeral 102.

The pair of mounts 79 are fixed to the base 12 by the pair of support posts 42. The support posts 42 are of identical structure. Here, reference is made to the support post depicted in cutaway view on the right in FIG. 3. The mount 79 has a through hole formed therein along the z-direction. An outer sleeve 81 that forms a part of the post is provided underneath the mount 79. The outer sleeve 81 has a through hole along the z-direction. A long bolt 82 is provided penetrating through the above-noted two through holes, which are aligned in the z-direction. A lower end portion 82B of the bolt 82 constitutes a screw portion. Further, a threaded hole 84 is formed in the base 12. The lower end portion 82B is inserted into the threaded hole 84, and these two elements are screwed together. A lower end portion of the outer sleeve 81 is also inserted into an upper part of the threaded hole 84.

A head 82A of the bolt 82 is exposed upward from the mount 79. The head 82A has a hexagonal recess to be engaged by a tip of a tool. By introducing a long tool from above as indicated by reference numeral 85, the tip of the tool can be easily introduced into the recess. By rotating the tool in that state, fastening or removal of the bolt can be carried out. On the left side of the main body 54 also, bolt attachment and removal can be performed conveniently by introducing the tool in the same manner as described above. A structure similar to the above may be employed for each of the support posts that support the constructed unit.

The base 12 comprises a main part 51, and a peripheral part 52 surrounding the main part 51. The thickness of the main part 51 is greater than the thickness of the peripheral part 52. The pair of support posts for fixing the incidence regulator unit 38 and the plurality of posts for fixing the constructed unit are secured to the main part 51. The housings located on the upper side are fixed to the peripheral part 52.

Figure 4:
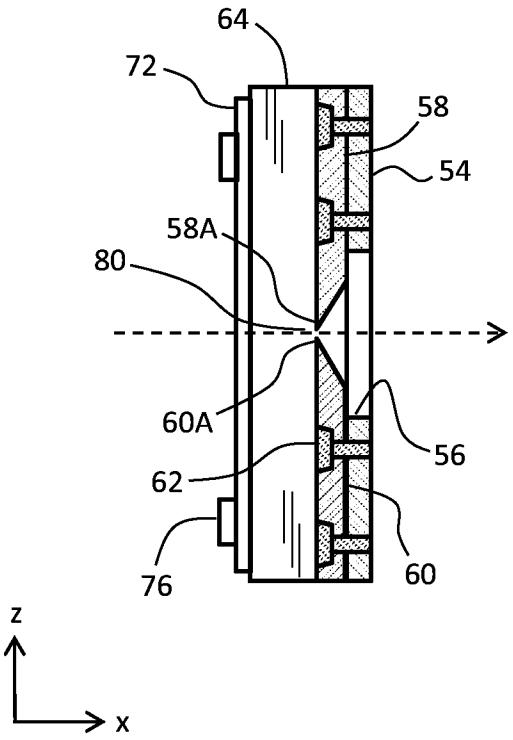
FIG. 4 is a cross-sectional view of the incidence regulator unit.

FIG. 4 shows a cross-section indicated by IV in FIG. 3. The main body 54 comprises, in the y-direction, a thin part and thick parts located on both sides thereof, and the pair of blades 58, 60 are attached to the thin part by the plurality of screws 62. The edges 58A, 60A that form parts of the blades 58, 60 define the size of the slit 80 in the z-direction. The thin part has the opening 56. On a far side of the thin part in the depth direction, a thick part is present, and this part constitutes the heater unit 64. That is, a U-shaped groove is formed in the thick part, and a heater is arranged therein. The U-shaped groove is covered with the cover 72, which is fastened with the plurality of screws 76. A structure similar to that described above is also located on the near side of the thin part. Each of the support posts is composed of electrically conductive members. The base and the respective housings are set to ground potential, and the pair of blades 58, 60 are also set to ground potential.

Figure 5:
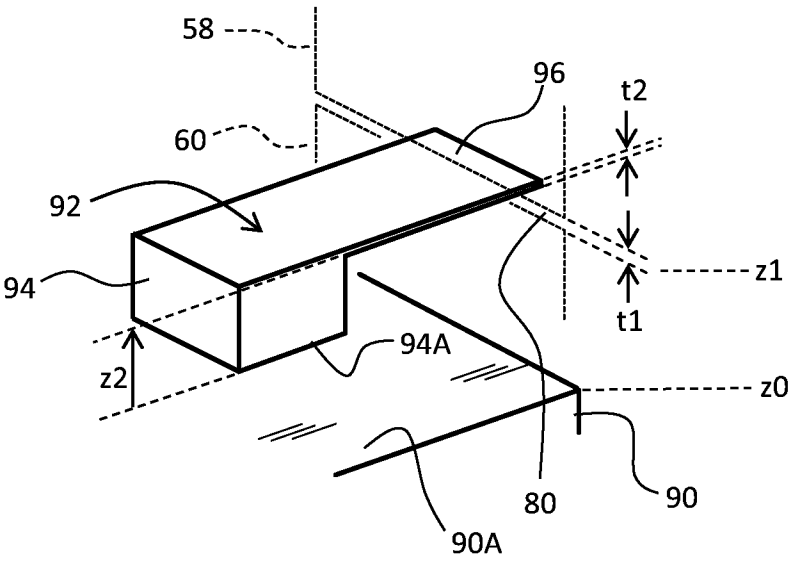
FIG. 5 is a diagram for explaining positioning of the incidence regulator unit.

FIG. 5 illustrates, in a schematic diagram, an instance of positioning of the slit 80. For example, positioning of the slit 80 can be performed using a jig 92. As already explained above, the slit 80 is defined by the pair of blades 58, 60. The size of the slit 80 in the z-direction is indicated by t1. The central height of the slit 80 is at z1. In the example shown, the height z0 of an upper face 90A of a pusher electrode 90 serves as a reference.

The jig 92 comprises a block-shaped main body 94, and a piece 96 that extends from the main body 94 in the horizontal direction. The size of the piece 96 in the z-direction is t2. From a substantial point of view, t2 is equal to t1. In a state in which a lower face 94A of the main body 94 is in close contact with the upper face 90A, the intermediate level of the piece 96 is at height z2. When the height z2 is equal to the height z1; that is, when the piece 96 can be smoothly inserted into the slit 80 in that state, it can be determined that the height of the slit 80 is appropriate. When the piece 96 cannot be inserted into the slit 80, the height of the slit 80 is to be adjusted.

By performing confirmation or adjustment of the height of the slit 80, the incident ion flow can be appropriately arranged in place with respect to the reference plane of the orthogonal acceleration unit. The position and size of the slit may be confirmed or adjusted using a jig other than the jig shown. For example, the size of the slit 80 in the z-direction is 1 mm. For example, the length of the piece 96 is a few or several millimeters. For example, the jig is made of a metal.

For example, the size of the main body of the jig in the horizontal directions is 10 mm by 10 mm. All numerical values mentioned in this specification are examples only.

The above-described embodiment includes a plurality of characteristic features. The individual characteristic features can also be used alone.

The invention claimed is:

1. A mass spectrometry device, comprising:

a base;

a constructed unit including a pulse generator unit that generates ion pulses from an ion flow;

a first support member that fixes the constructed unit with respect to the base while spacing the constructed unit from the base;

an incidence regulator unit provided upstream of the pulse generator unit and having a slit through which the ion flow passes; and a second support member that fixes the incidence regulator unit with respect to the base while spacing the incidence regulator unit from the base and the constructed unit, wherein the incidence regulator unit includes:

a main body;

a pair of blades provided on the main body and defining the slit; and a heat source provided on the main body and serving to heat the pair of blades, and wherein a direction parallel to a direction of travel of the ion flow is defined as a first direction, a direction orthogonal to the first direction and parallel to the slit is defined as a second direction, and a direction orthogonal to the first direction and the second direction is defined as a third direction, the main body extends in the second direction and the third direction;

a pair of mounts are provided projecting toward both sides in the second direction from an end portion of the main body, which end portion being located toward the base;

the second support member is a pair of support posts provided between the base and the pair of mounts; and each of the support posts extends in the third direction.

2. The mass spectrometry device according to claim 1, wherein each of the support posts comprises a bolt, wherein the bolt is placed through a through hole formed in a corresponding one of the mounts and a through hole formed in the support post, and is coupled to the base; and a head of the bolt is exposed at the mount.

3. The mass spectrometry device according to claim 1, wherein the heat source includes:

a first heater embedded in the main body on one side of the pair of blades; and a second heater embedded in the main body on the other side of the pair of blades.

4. The A mass spectrometry device comprising:

a base;

a constructed unit including a pulse generator unit that generates ion pulses from an ion flow;

a first support member that fixes the constructed unit with respect to the base while spacing the constructed unit from the base;

an incidence regulator unit provided upstream of the pulse generator unit and having a slit through which the ion flow passes; and a second support member that fixes the incidence regulator unit with respect to the base while spacing the incidence regulator unit from the base and the constructed unit, wherein on one side of the base, there are provided the constructed unit, the first support member, the incidence regulator unit, and the second support member, and further, a reflector unit that reflects ions from the pulse generator unit;

on the other side of the base, a detector that detects ions from the reflector unit is provided; and a member that holds the detector is fixed with respect to the base.

* * * * *